US009219306B2

(12) United States Patent
Song et al.

(10) Patent No.: US 9,219,306 B2
(45) Date of Patent: Dec. 22, 2015

(54) PRINTED CIRCUIT BOARD ANTENNA, PRINTED CIRCUIT BOARD, AND ELECTRONIC DEVICE

(71) Applicants: AMBIT MICROSYSTEMS (SHANGHAI) LTD., Shanghai (CN); HON HAI PRECISION INDUSTRY CO., LTD., New Taipei (TW)

(72) Inventors: Ai-Ning Song, Shanghai (CN); Xiao-Yan Liu, Shanghai (CN); Cho-Ju Chung, New Taipei (TW)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 323 days.

(21) Appl. No.: 13/952,786

(22) Filed: Jul. 29, 2013

(65) Prior Publication Data

US 2014/0132470 A1 May 15, 2014

(30) Foreign Application Priority Data

Nov. 13, 2012 (CN) ..... 2012 2 05962521 U

(51) Int. Cl.
*H01Q 1/50* (2006.01)
*H01Q 1/38* (2006.01)

(52) U.S. Cl.
CPC ... *H01Q 1/50* (2013.01); *H01Q 1/38* (2013.01)

(58) Field of Classification Search
CPC ..... H01Q 1/50; H01Q 1/38; H01Q 1/243
USPC ..... 343/700 MS, 702, 841, 860, 703
See application file for complete search history.

(56) References Cited

U.S. PATENT DOCUMENTS

2010/0295569 A1* 11/2010 Chu et al. ..... 324/754
2011/0037667 A1* 2/2011 Varjonen et al. ..... 343/703
2013/0194139 A1* 8/2013 Nickel et al. ..... 343/703

* cited by examiner

*Primary Examiner* — Hoanganh Le
(74) *Attorney, Agent, or Firm* — Novak Druce Connolly Bove + Quigg LLP

(57) ABSTRACT

A printed circuit board (PCB) antenna includes an antenna matching network, an antenna body, and a high frequency (HF) connector. The antenna matching network is used to electrically connect to a signal processing circuit. The antenna body is connected to the antenna matching network, the antenna body includes a bared area, the bared area is used to electrically connect to a conductive object and then to be grounded when the signal processing circuit is needed to be tested. The high frequency (HF) connector is electrically connected to the antenna body and is used to connect to a test device when the signal processing circuit is needed to be tested.

10 Claims, 5 Drawing Sheets

PRINTED CIRCUIT BOARD ANTENNA, PRINTED CIRCUIT BOARD, AND ELECTRONIC DEVICE

BACKGROUND

1. Technical Field

The present disclosure relates to antennas, and particularly to a printed circuit board (PCB) antenna, a PCB with the PCB antenna, and an electronic device.

2. Description of Related Art

An antenna is a necessary part of electronic devices with a communication function, such as, mobile phones and tablet computers. Usually, in order to reduce size of the electronic device, antennas are printed on a printed circuit board (PCB) to reduce overall size, which is more and more popular. As shown in FIG. 5, a common PCB antenna 1' includes an antenna body 10 and an antenna matching network 20. The antenna matching network 20 of the PCB antenna 1' is connected to a signal processing circuit 2, the signal processing circuit 2 is used to process signals transmitted by the antenna matching network 20. In the common PCB antenna 1', in order to test a radio-frequency (RF) performance of the signal processing circuit 2, the PCB antenna 1' also includes a RF connector 30. The RF connector 30 is connected between the antenna matching network 20 and the signal processing circuit 2, and is used to connect a connector of a test device (not shown). In general, in order to prevent the interference of the PCB antenna 1', the RF connector 30 usual includes a mechanical switch structure. When the RF connector 30 is connected to the connector of the test device, the RF connector 30 cuts off the connection of the antenna matching network 20 and the signal processing circuit 2 and connects the signal processing circuit 2 with the connector of the test device. Thus preventing the interference of the PCB antenna 1'. When the RF connector 30 stops connecting to the connector of the test device, the RF connector 30 connects the antenna matching network 20 and the signal processing circuit 2 again, then the PCB antenna 1' can work normally. However, the common RF connector 30 is expensive.

A charger and an electronic device to overcome the described limitations are thus needed.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will be described with reference to the accompanying drawings.

Figure 1:
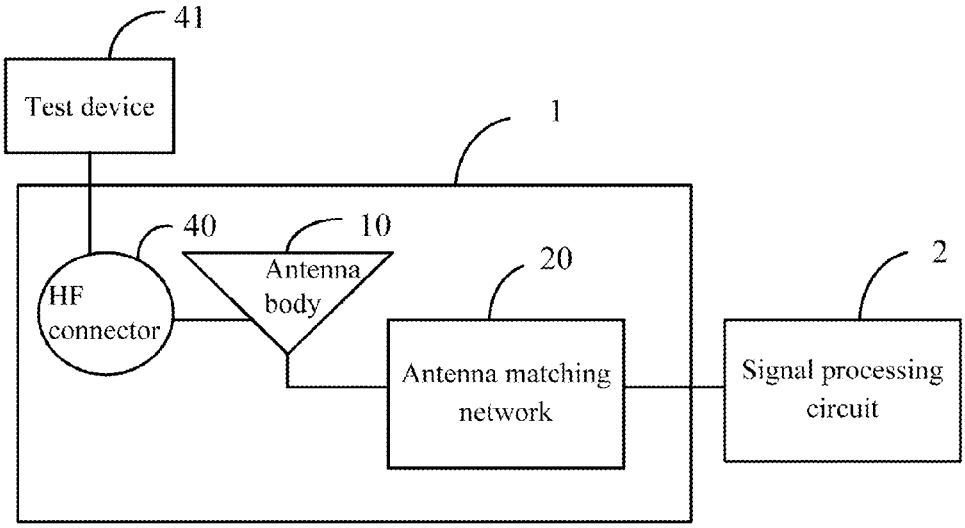
FIG. 1 is a schematic diagram of an embodiment of a printed circuit board (PCB) antenna.
Figure 2:
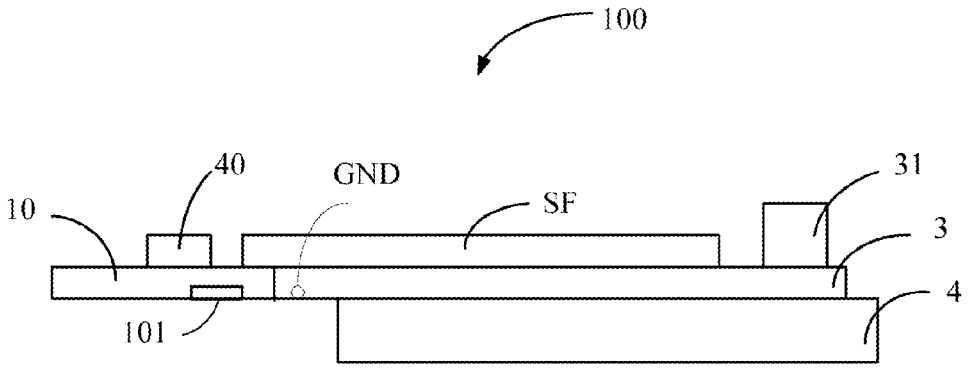
FIG. 2 is a schematic diagram of an embodiment of a printed circuit board with a PCB antenna, such as that of FIG. 1.

FIGS. 1 and 2 together show a printed circuit board (PCB) antenna 1. The PCB antenna 1 includes an antenna body 10, an antenna matching network 20, and a high frequency (HF) connector 40. The HF connector 40 is connected to the antenna body 10, and the antenna matching network 20 is connected to the antenna body and a signal processing circuit 2. The HF connector 40 is used to connect to a test device 41.

The antenna body 10 includes a bared area 101. The bared area 101 is used to electrically contact with a conductive object MC to ground when testing the signal processing circuit 2. The bared area 101 is a conductive area with any shape.

When the PCB antenna 1 is working normally, the HF connector 40 is taken as a portion of the PCB antenna 1 to enlarge a length of the PCB antenna 1, thus enhancing the performance of the PCB antenna 1.

As shown in FIG. 2, a PCB 100 printed with the PCB antenna 1 is illustrated. The PCB 100 includes a PCB body 3 and a substrate 4. The PCB antenna 1 is printed on the PCB body 3, the substrate 4 is used to hold the PCB body 3. In the embodiment, the PCB 100 also includes a ground point GND. The PCB antenna 1 is printed on an end of the PCB 100 and the ground point GND closes to the PCB antenna 1. The PCB antenna 1 and the ground point GND are extended out from the substrate 4, namely, the substrate 4 does not cover the PCB antenna 1 and the ground point GND. The bared area 101 is exposed on a surface of the antenna body 10, such as the surface facing the substrate 4.

Figure 3:
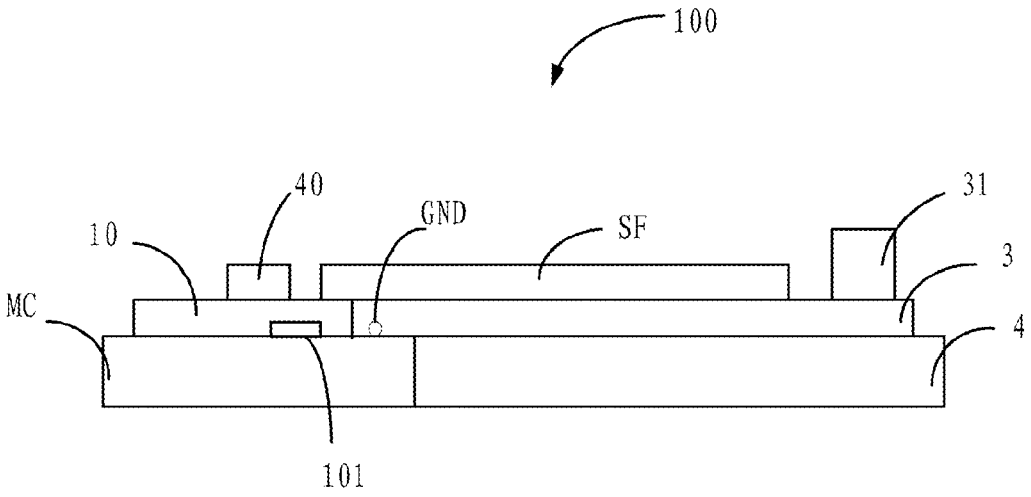
FIG. 3 is a schematic diagram of an embodiment of the printed circuit board printed with the PCB antenna when being tested.

FIG. 3 shows that the PCB 100 also includes shielding layer SF and a PCB connector 31. The shielding layer SF is used to shield electromagnetic interferences of the PCB 100. The PCB connector 31 is set on the PCB body 3 and is used to connect the PCB body 3 to other elements, such as processor, memory, for example.

When there is need to test the signal processing circuit 2, through adding the conductive object MC to a portion of the antenna body 10 corresponding to location of the bared area 101. The conductive object MC is electrically connected to the bared area 101 and the ground point GND, thus making the bared area 101 to electrically connect to the ground point GND via the conductive object MC. Then the antenna body 10 is grounded accordingly. Therefore, the signals received by the antenna body 10 are transmitted to ground directly and are not transmitted to the signal processing circuit 2 and do not interfere the signal processing circuit 2.

At the same time, the antenna body 10 and the antenna matching network 20 are taken as a conductive line, the HF connector 40 connects to the signal processing circuit 2 via the antenna body 10 and the antenna matching network 20. When the HF connector 40 is connected to the test device 41, the test device 41 is connected to the signal processing circuit 2 and the signal processing circuit 2 then can be tested accordingly.

In the embodiment, the conductive object MC can be a conductive pad or a conductive tape. When there is need to test the signal processing circuit 2, by adding the conductive object MC, it is capable of preventing the interference of the PCB antenna 1. When there is not need to test the signal processing circuit 2, the PCB antenna 1 can work normally by removing the conductive object MC.

In the embodiment, the HF connector 40 does not need to include the mechanical switch structure, thereby decreasing the cost.

Figure 4:
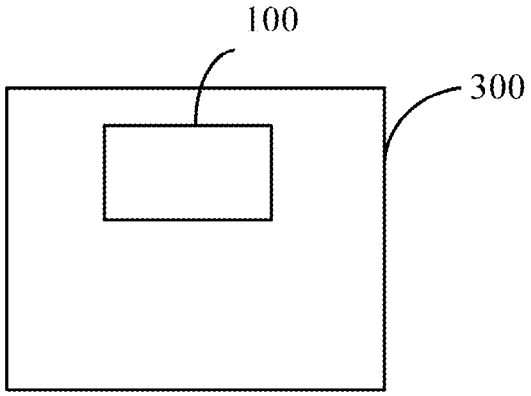
FIG. 4 is a schematic diagram of an embodiment of an electronic device with a printed circuit board, such as that of FIG. 2.
Figure 5:
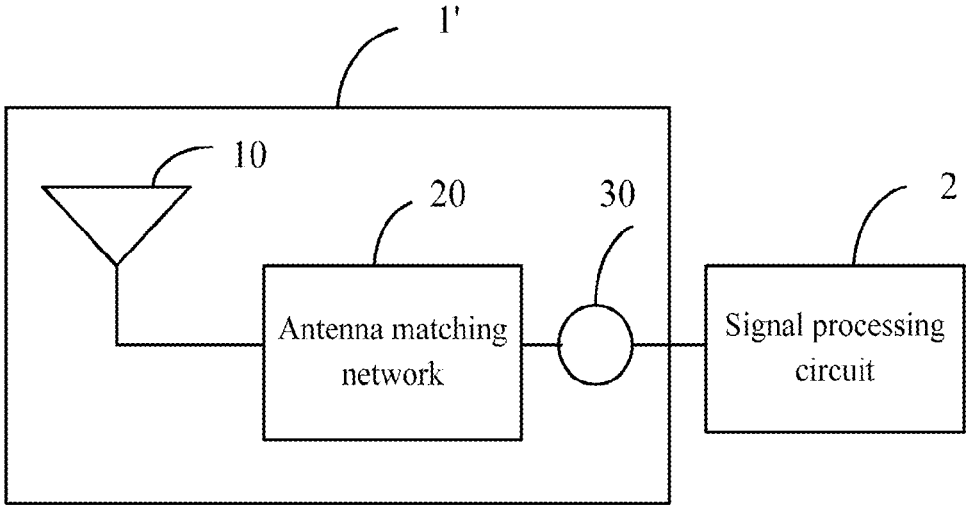
FIG. 5 (Related Art)
FIG. 5 is a schematic diagram of a PCB antenna in a related art.

FIG. 4 shows an electronic device 200 with the PCB 100. The electronic device 200 includes the PCB 100 as shown in FIG. 2 and other elements, such as display unit, processor, memory, and the like. The PCB 100 can be a motherboard, a flexible printed board circuit, for example.

The electronic device 200 can be a mobile phone, a tablet computer, a notebook computer, a digital photo frame, for example.

It is understood that the present embodiments and their advantages will be understood from the foregoing description, and various changes may be made thereto without departing from the spirit and scope of the disclosure or sacrificing all of its material advantages, the examples hereinbefore described merely being embodiments of the present disclosure.

What is claimed is:

1. A printed circuit board (PCB) antenna, comprising:

an antenna matching network configured to electrically connect to a signal processing circuit;

an antenna body connected to the antenna matching network, wherein, the antenna body comprises a bared area, the bared area is configured to electrically connect to a conductive object and then to be grounded when the signal processing circuit needs to be tested; and a high frequency (HF) connector electrically connected to the antenna body.

2. The PCB antenna according to claim 1, wherein when testing the signal processing circuit, the bared area is electrically connect to a ground point via the conductive object, signals received by the antenna body are transmitted to ground directly.

3. The PCB antenna according to claim 2, wherein the HF connector is configured to connect to a test device; when the bared area is electrically connected to the ground point via the conductive object, the HF connector is connected to the signal processing circuit via the antenna body and the antenna matching network, when the HF connector is connected to the test device, the HF connector connects the signal processing circuit to the test device.

4. An printed circuit board (PCB) comprising:

a PCB body;

a substrate configured to hold the PCB body; and a PCB antenna printed on the an end of the PCB body, wherein the PCB antenna comprises an antenna body, an antenna matching network, and a high frequency (HF) connector electrically connected to the antenna body, the antenna matching network is configured to connect with a signal processing circuit;

wherein, the PCB body further comprises a ground point closed to the PCB antenna and a bared area configured to electrically contact with a conductive object to connect to ground when testing the signal processing circuit.

5. The PCB according to claim 4, wherein PCB further comprises a shielding layer and a PCB connector, the shielding layer is configured to shield electromagnetic interferences of the PCB, the PCB connector is set on the PCB body and is configured to connect the PCB body to other elements.

6. The PCB according to claim 4, wherein the HF connector is configured to connect to a test device; when the bared area is electrically connected to the ground point via the conductive object, the HF connector is connected to the signal processing circuit via the antenna body and the antenna matching network, when the HF connector is connected to the test device, the HF connector connects the signal processing circuit to the test device.

7. An electronic device, comprising a printed circuit board (PCB), the printed circuit board (PCB) comprises a PCB body, a substrate, and a PCB antenna; wherein, the substrate is configured to hold the PCB body; the PCB antenna is printed on the an end of the PCB body, the PCB antenna comprises an antenna body, an antenna matching network, and a high frequency (HF) connector electrically connected to the antenna body, the antenna matching network is configured to connect with a signal processing circuit;

wherein, the PCB body further comprises a ground point closed to the PCB antenna and a bared area configured to electrically contact with a conductive object to connect to ground when testing the signal processing circuit.

8. The electronic device according to claim 7, wherein PCB further comprises a shielding layer and a PCB connector, the shielding layer is configured to shield electromagnetic interferences of the PCB, the PCB connector is set on the PCB body and is configured to connect the PCB body to other elements.

9. The electronic device according to claim 8, wherein the HF connector is configured to connect to a test device; when the bared area is electrically connected to the ground point via the conductive object, the HF connector is connected to the signal processing circuit via the antenna body and the antenna matching network; when the HF connector is connected to the test device, the HF connector connects the signal processing circuit to the test device.

10. The electronic device according to claim 7, wherein the electronic device is one selected from a group consist of a mobile phone, a tablet computer, a notebook computer, and a digital photo frame.

* * * * *